US005927703A

United States Patent [19]

Endo

[11] Patent Number: 5,927,703

[45] Date of Patent: Jul. 27, 1999

[54] SHEET FEEDING APPARATUS

[75] Inventor: Kenji Endo, Fukushima, Japan

[73] Assignee: Tohoku Ricoh Co., Ltd., Miyagi, Japan

[21] Appl. No.: 08/719,960

[22] Filed: Sep. 24, 1996

[30] Foreign Application Priority Data

Dec. 26, 1995 [JP] Japan ..... 7-338989
Jul. 17, 1996 [JP] Japan ..... 8-187668

[51] Int. Cl.[6] ..... B65H 5/00

[52] U.S. Cl. ..... 271/10.03; 271/10.11; 271/117; 271/242; 271/265.04

[58] Field of Search ..... 271/10.09, 10.11, 271/10.03, 117, 121, 242, 262, 263, 265.04

[56] References Cited

U.S. PATENT DOCUMENTS 3,961,786 6/1976 Yanker ..... 271/10.03 X
5,664,771 9/1997 Nagatani et al. ..... 271/10.03

FOREIGN PATENT DOCUMENTS 4-23862 6/1992 Japan .
5-18342 5/1993 Japan .
5-32296 5/1993 Japan .
7-170579 7/1995 Japan .

*Primary Examiner*—David H. Bollinger
*Attorney, Agent, or Firm*—Oblon, Spivak, McClelland, Maier & Neustadt, P.C.

[57] ABSTRACT

A sheet feeding apparatus for image producing systems such a stencil duplicating machine, a printer, and a copying machine. The sheet feeding apparatus comprises a sheet feed roller, a sheet feeding pressure regulator, a pair of register rollers, a sheet feeding time detector, and a control unit. The control unit compares a sheet feeding time detected by the sheet feeding time detector with a predetermined reference sheet feeding time, and controls a sheet feeding pressure on the basis of a compared result during a sheet feeding operation.

14 Claims, 6 Drawing Sheets

SHEET FEEDING APPARATUS

BACKGROUND OF THE INVENTION

1. Field of the Invention

This invention relates to a sheet feeding apparatus for feeding sheets (including original documents) in image processing systems such as a printer, a copying machine, a stencil duplicating machine, and a document reader.

2. Description of the Prior Art

FIG. 8 of the accompanying drawings shows a sheet feeding apparatus for a printer. In operation, a sheet feed roller 202 (called "the feed roller 202") successively pays out sheets 201 from a sheet tray 200 from top to bottom. Each paid out sheet 201 is separated from the remaining sheets 201 by a separating roller 203 and a separating pad 204, and is fed into a space between a pair of register rollers 205. The register rollers 205 are rotated in synchronization with the rotation of a printing drum 206, so that an image perforated on a stencil wrapped around the printing drum 206 is transferred (or printed) onto the sheet 201. Thereafter, the sheet 201 is conveyed to a discharge tray 208 via an absorbing unit 207.

The feed roller 202 has at least a surface made of a material with a high friction coefficient such as rubber. A frictional force between the feed roller 202 and a top sheet 201 is designed to be larger than a frictional force between the sheets 201. The former frictional force depends upon a sheet feeding pressure (i.e. a pressure applied by the feed roller 202 to the sheets 201). The smaller the sheet feeding pressure, the oftener the feed roller 202 slips on the sheet 201, and fails to pay it out. Conversely, the larger the sheet feeding pressure, the oftener the feed roller 202 feeds a plurality of sheets 201 at a time.

Therefore, it is necessary to maintain the sheet feeding pressure constant, since it is continuously variable with factors such as a kind, a size and an amount of sheets 201, a printing speed, and so on. Referring to FIG. 8, a sheet feeding pressure regulator 209 (called the "feeding pressure regulator 209") regulates the sheet feeding pressure, and includes an arm 211 which is connected at its base to a stationary shaft 210, has a weight 212 at its free end, and is longitudinally movable at the free end. The arm 211 supports the feed roller 202 at the free end, so that the feed roller 202 is freely rotatable. The feeding pressure regulator 209 urges the arm 211 upward via a spring 214 connected to a side plate of the printer via a regulating member 213. The regulating member 213 includes a plurality of hooks, with which the spring 214 is engaged so as to regulate the sheet feeding pressure.

A pressure by which the sheets 201 comes into contacts with the separating roller 203 affects sheet separating functions. A separating pressure regulator 215 is provided in order to regulate this pressure, and comprises a spring 216 which is engaged with the separating pad 204 at its one end, and with a member 217 at the other end thereof. The member 217 or the separating pad 204 includes a plurality of hooks (not shown in FIG. 8) to which a spring 216 is secured so as to regulate a pressure applied by the separating pad 204 to the sheet separating roller 203, i.e. a sheet separating pressure.

Japanese Patent Publication No. Hei 5-032,296 discloses a sheet feeding apparatus, which includes a mechanism for disabling the rotation of a sheet separating/feeding roller when a sheet separating pad displaces itself from the sheet separating/feeding roller by an amount which is above a predetermined value, i.e. when two or more sheets are simultaneously separated and fed (called "multiple sheet feeding" hereinafter). In the case of multiple sheet feeding, this mechanism is intended to interrupt sheet feeding at an inlet of a sheet feed path, and to prevent the register rollers from being damaged by sheets which are simultaneously fed and have a certain thickness.

Further, Japanese Utility Model Publication No. Hei 4-023,862 describes a technique to overcome a disadvantage of a tilting sheet tray. Specifically, such a sheet tray tends to cause multiple sheet feeding when the sheet tray is lifted and becomes substantially flush with a sheet separating roller, and does not function as a front enclosure as sheets are being paid out therefrom. In this publication, the sheet tray is attached to a free end of an arm which is rotatably supported. An inclination of the sheet tray is controlled in accordance with a length of the arm.

In the prior art shown in FIG. 8, in order to regulate the sheet feeding or separating pressure, it is necessary for an operator to manually change a position for securing the spring with a hook, which is very troublesome. Further, the sheet feeding or separating pressure delicately varies with kinds of sheets (e.g. thickness and quality of paper). Thus, this adjustment requires dexterity and quick response of the operator, and is not performed so reliably.

Japanese Patent Publication No. Hei 5-032,296 relates the technique which is applied after multiple sheets are fed at a time, but it is not intended to prevent multiple sheet feeding. Thus, whenever multiple sheet feeding is caused, the printing operation should be suspended so as to remove jammed sheets.

The last mentioned publication relates to the technique for preventing multiple sheet feeding simply by paying attention to the function of the sheet tray as the front enclosure. No measures are taken into consideration from the viewpoint of the sheet feeding pressure and the kind of sheets.

In order to reliably feed each sheet to a printing section, the sheet feeding apparatus is continuously required to maintain appropriate sheet feeding and separating pressures in accordance with the kinds of sheets. However, it does not always follow that once the sheet feeding and separating pressures are appropriately determined with accordance with the kinds of sheets, neither no-sheet feeding nor multiple sheet feeding should take place.

This is because the factors affecting the sheet feeding and separating pressures, i.e. the thickness and quality of sheets, tend to vary with environmental conditions in the printer (e.g. temperature, humidity and so on).

Further, the foregoing sheet feeding apparatus is disadvantageous in the following respect: no-sheet feeding caused during use by a worn feed roller; or waste of time when the operation is suspended in order to replace a worn-out feed roller. At present, no particular measures have been taken from this viewpoint.

Even when a sheet feeding pressure and a sheet separating pressure are automatically adjustable by a sheet feeding pressure regulating mechanism and a sheet separating pressure regulating mechanism, either no-sheet feeding or multiple sheet feeding caused by such a sheet feeding or separating pressure should be attended by the operator (i.e. the operator should manipulate the control panel so as to resume the automatic adjustment). This job requires the operator's dexterity and quick response.

SUMMARY OF THE INVENTION

The present invention is aimed at providing a sheet feeding apparatus which can automatically set appropriate sheet feeding and separating pressures in accordance with kinds and states of sheets, and printing speeds, and which can reliably prevent no-sheet feeding and multiple sheet feeding.

Further, the invention is intended to provide a sheet feeding apparatus which can overcome economic disadvantages caused by wear of the sheet feed roller during its use.

In the invention, not only a sheet feeding pressure regulating mechanism (called the "feeding pressure regulator") and a sheet separating pressure regulating mechanism (called the "separating pressure regulator") perform their functions automatically, but also the sheet feeding apparatus itself detects, on the real time basis, environmental factors, and determines states of sheets based on the detected environmental factors. Thus, the sheet feeding apparatus automatically sets appropriate sheet feeding and separating pressures.

In other words, the sheet feeding apparatus not only performs its sheet feeding and separating functions but also performs feed-back control of the sheet feeding and separating pressures in accordance with variations of the environmental factors, and changes these pressures during the sheet feeding operation, if necessary.

According to a first aspect of the invention, there is provided a sheet feeding apparatus which is applicable to a stencil duplicating machine or the like, and comprises: a sheet feed roller for feeding sheets toward a printing section; a sheet feeding pressure regulating mechanism for regulating a sheet feeding pressure; a pair of register rollers for periodically conveying the sheets to the printing section; a sheet feeding time detector for detecting a sheet feeding time, the sheet feeding time detector being positioned upstream of the register rollers in a sheet feed path; and a control unit for controlling operations of the foregoing members, the control unit comparing a sheet feeding time detected by the sheet feeding time detector with a predetermined reference sheet feeding time, and controlling the sheet feeding pressure regulating mechanism on the basis of a compared result during a sheet feeding operation.

In this arrangement, the sheet feeding pressure can be automatically controlled to an optimum value in accordance with the sheet feeding time which is continuously detected and compared with the predetermined reference sheet feeding time. This is effective in preventing no-sheet feeding. Further, the sheet feeding pressure can be controlled without suspending the printing operation, which is effective in preventing waste of time caused by the suspended printing operation. Still further, the feed roller is substantially free from an excessive sheet feeding pressure, so that it can reliably operate for a long period of time without wear.

In the first aspect, the control unit calculates the sheet feeding time. The sheet feeding time can be detected using a simple structure.

The sheet feeding time detector may detect sheet feeding times of a plurality of sheets, and an average of detected sheet feeding times is compared with the predetermined reference sheet feeding time. Thus, the sheet feeding time can be reliably determined with being affected by randomly obtained sheet feeding times.

The sheet feeding apparatus further may comprise a sheet size sensor. The sheet size sensor detects a sheet size, a sheet feeding time of a sheet of the detected size is compared with a reference sheet feeding time predetermined for the corresponding sheet size.

Further, the sheet feeding apparatus may comprise a sheet size setting member. When the sheet size setting member sets a sheet size, a sheet feeding time of a sheet of the set size is compared with a reference sheet feeding time predetermined for the corresponding sheet size.

The foregoing arrangement is effective in reliably preventing no-sheet feeding and multiple sheet feeding.

The sheet feeding apparatus may further comprise a sheet kind sensor. When the sheet kind sensor detects a sheet kind, a sheet feeding time of a sheet of the detected kind is compared with a reference sheet feeding time predetermined for the corresponding sheet kind.

The sheet feeding apparatus may further comprise a sheet kind setting member. When the sheet kind setting member sets a sheet kind, a sheet feeding time of a sheet of the set kind is compared with a reference sheet feeding time predetermined for the corresponding sheet kind.

This arrangement is effective in reliably preventing no-sheet feeding and multiple sheet feeding.

The sheet feeding apparatus may further comprise a printing speed setting member. When a printing speed is set by the printing speed setting member, a sheet feeding time for the set printing speed is compared with a reference sheet feeding time predetermined for the corresponding printing speed. It is possible to determine an optimum sheet feeding pressure in accordance with a printing speed. Further, no-sheet and an excessive sheet feeding pressure can be reliably and effectively prevented.

The sheet feeding apparatus may further comprise an environment sensor for detecting factors such as temperature and humidity in the stencil duplicating machine or the like. A sheet feeding time under the detected temperature or humidity is compared with a reference sheet feeding time predetermined for the corresponding temperature or humidity. It is possible to prevent both no-sheet feeding and an excessive sheet feeding pressure more reliably and more effectively.

In the sheet feeding apparatus, the control unit issues an advance notice concerning the time for exchanging the sheet feed roller when the sheet feeding pressure of the sheet feeder roller reaches a predetermined sheet feeding pressure, and urges to exchange the sheet feed roller when the sheet feeding pressure is above a predetermined maximum value and when the sheet feeding time exceeds the predetermined sheet feeding time. The advance notice promotes preparation of a fresh feed roller, and minimizes a time which is necessary for preparing and replacing a worn-out feed roller.

The sheet feeding pressure can be optionally determined. Even when non-standard sheets are used, the optimum sheet feeding pressure will be set for such sheets, and will be reset to an initial value after they are discharged.

The sheet feeding pressure can be updated and be optionally reset to an initial value. This enables the sheet feeding operation to be performed in an optimum state.

Further, the sheet feeding apparatus may comprise a multiple feed sensor for detecting multiple sheet feeding, disposed upstream of the register rollers in the sheet feed path, and a sheet separating pressure regulating mechanism for regulating a sheet separating pressure. When multiple sheet feeding is detected by the multiple feed sensor, the control unit operates the sheet separating pressure regulating mechanism, which regulates the sheet separating pressure. No-sheet feeding and multiple sheet feeding can be reliably and effectively prevented without an operator's assistance.

In accordance with a second aspect of the invention, there is provided a sheet feeding apparatus which is applicable to a stencil duplicating machine or the like, and comprises: a sheet feed roller for feeding sheets to a printing section; a sheet separating pressure regulating mechanism for regulating a sheet separating pressure; a pair of register rollers for periodically conveying the sheets to the printing section; a multiple sheet feeding sensor for detecting multiple sheet feeding, the multiple sheet feeding sensor being disposed upstream of the register rollers in a sheet feed path; and a control unit for controlling operations of the foregoing members, and operating the sheet separating pressure regulating mechanism when multiple sheet feeding is detected by the multiple sheet feeding sensor.

This arrangement enables no-sheet feeding and multiple sheet feeding to be reliably detected without an operator's assistance. Further, the separating pad can be protected against receiving an excessive separating pressure, and against being unnecessarily worn out.

BRIEF DESCRIPTION OF THE DRAWINGS

The invention will become more fully understood from the detailed description given by way of illustration only, and thus are not limitative of the present invention. In all Figures, identical parts have identical reference numbers.

DETAILED DESCRIPTION OF THE PREFERRED EMBODIMENTS

The invention will be described with reference to an embodiment (applied to a printer 2) shown in FIGS. 1 to 5.

Figure 1:
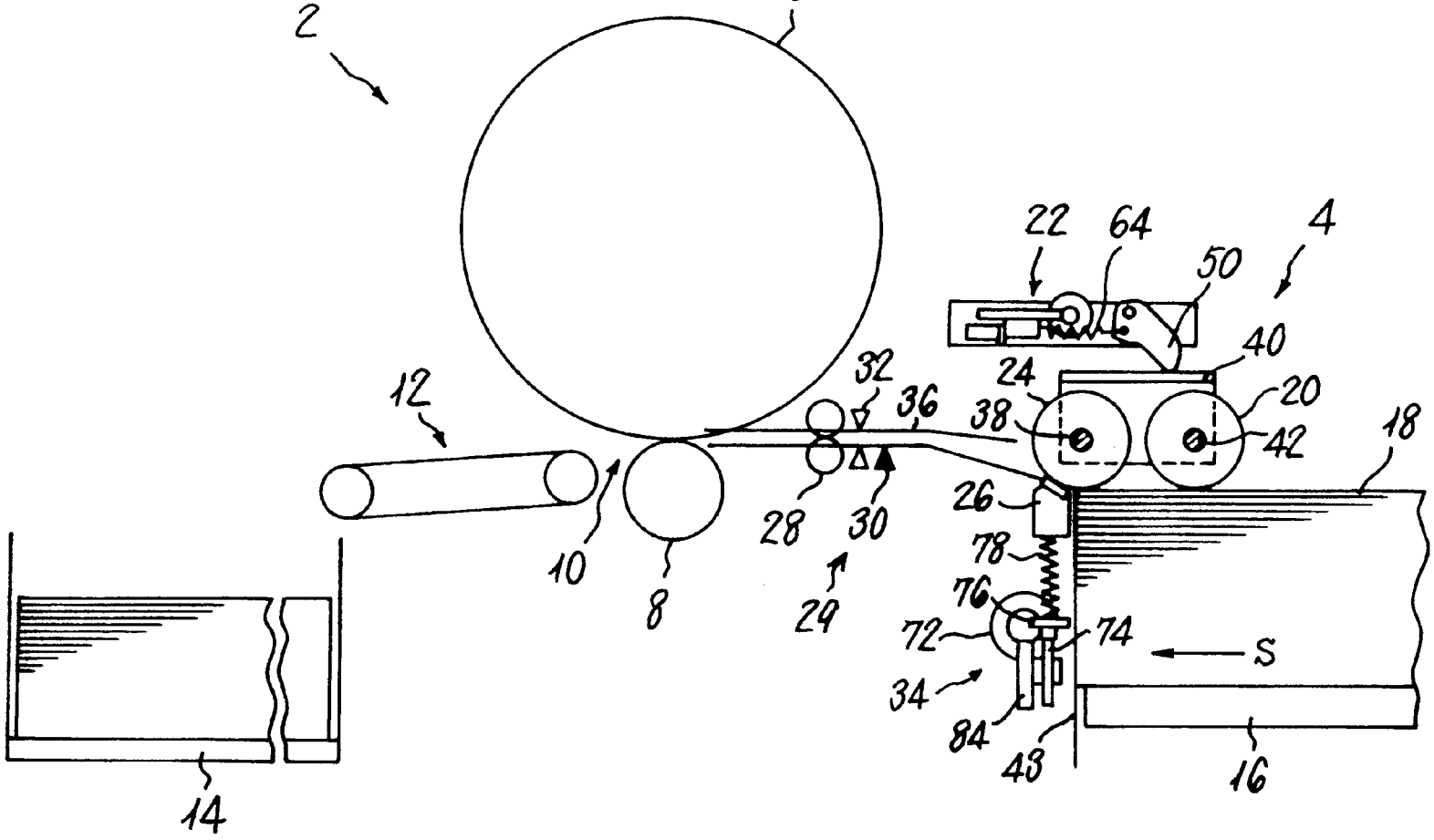
FIG. 1 is a schematic side view of a printer into which a sheet feeding apparatus is incorporated in accordance with an embodiment of the invention.

Referring to FIG. 1, the printer 2 mainly comprises a sheet feeding apparatus 4, a printing section 10 (including a printing drum 6 and a press roller 8), an absorbing unit 12, and a printed sheet tray 14.

The sheet feeding apparatus 4 includes a sheet feed roller 20 (called the "feed roller 20"), a feeding pressure regulator 22, a separating roller 24, a separating pad 26, a separating pressure regulator 34, a pair of register rollers 28, a sheet feeding time detector 29, a control unit 93 (refer to FIG. 4), a multiple sheet feed detector 32, and a sheet guide 36 as a sheet feed path.

The feed roller 20 pays sheets 18 out from a sheet tray 16 toward the printing section 10. The feeding pressure regulator 22 regulates a sheet feeding pressure of the feed roller 20 toward the sheets 18. The separating roller 24 and the separating pad 26 in close contact with the roller 24 cooperate to prevent multiple sheet feeding. The separating pressure regulator 34 regulates a sheet separating pressure of the separating pad 26 toward the sheets 18. The register rollers 28 periodically feed sheets 18 to the printing section 10. The sheet feeding time detector 29 detects a time for feeding each sheet (called the "sheet feeding time" hereinafter), and is positioned along the sheet feed path and upstream of the register rollers 28.

In this embodiment, the sheet feeding time detector 29 includes a sensor 30 for detecting a leading edge of the sheet 18. The control unit 93 actually calculates the sheet feeding time.

The separating roller 24 and a feed arm 40 are rotatably supported on a shaft 38 which is attached to a predetermined position on a side plate (not shown) of the printer 2. The feed roller 20 is supported by a free end of the feed arm 40 via a shaft 42. Both the sheet feed roller 20 and the feed arm 40 as an integral unit are longitudinally movable via the shaft 38 functioning as a fulcrum. The feed roller 20 and the separating roller 24 are connected to a motor (not shown) for activating the feed roller 20. In FIG. 1, reference numeral 43 denotes a front plate for aligning the leading edges of sheets 18 on the sheet tray 16.

Figure 2:
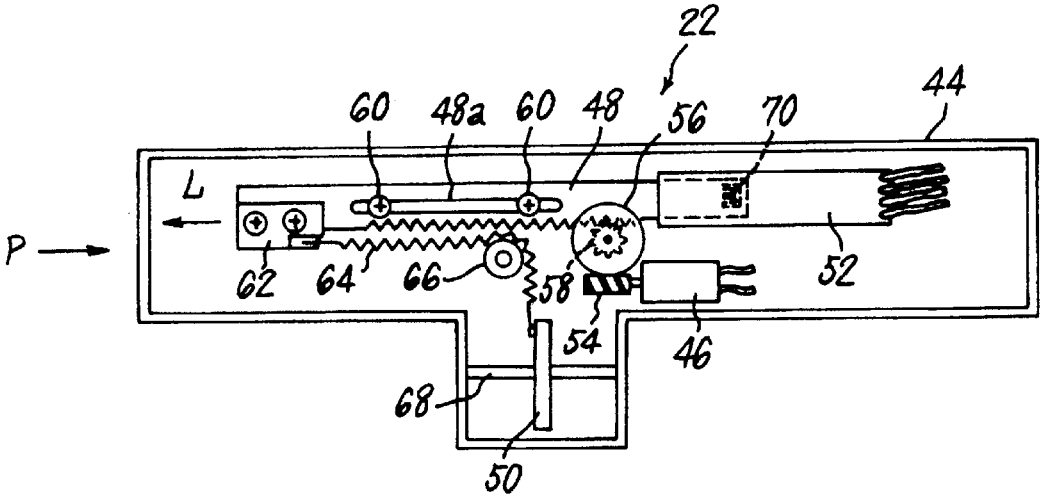
FIG. 2 is an enlarged top view of a feeding pressure regulator.

Referring to FIG. 2, the feeding pressure regulator 22 mainly includes a feed stay 44, a feeding pressure varying motor 46 (step motor), a rack 48, a pressure applying arm 50, and a position detecting substrate 52. The rack 48 is movable transversely of the sheets 18 by the feeding pressure varying motor 46. The pressure applying arm 50 applies a pressure to the feed arm 40. The position detecting substrate 52 detects a lateral displacement of the rack 48.

The feeding pressure varying motor 46 includes a worm 54 attached on its rotary shaft, and transmits its rotational force to the rack 48 via a worm wheel 56 and a pinion 58 integral therewith. The rack 48 has a slit 48*a* for moving itself. A lateral movement of the rack 48 is controlled by a pair of stepped screws 60. As shown in FIG. 2, a pressure applying spring 64 has its one end connected to one end of the rack 48 via a hook bracket 62, and has the other end thereof coupled to the pressure applying arm 50 via a pulley 66. The pressure applying arm 50 is supported by a shaft 68 attached to the feed stay 44, and is longitudinally movable. Returning to FIG. 1, the other end of the pressure applying spring 64 is positioned below a rotational center of the pressure applying arm 50. In other words, the rotational moment is generated at the pressure applying arm 50 by an urging force of the pressure applying spring 64. This rotational moment serves as a pressure for pushing the feed arm 41, i.e. a sheet feeding pressure. Whenever the rack 48 moves in the direction L, the pressure applying spring 64 increases its urging force, i.e. the sheet feeding pressure is increased.

The rack 48 has a contact piece 70 at its end near the position detecting substrate 52, which has a detecting pattern (not shown) thereon, and detects the lateral movement of the rack 48 by detecting a position of the contact piece 70 on the detecting pattern. FIG. 1 shows feeding pressure regulator 22 viewed from the direction P in FIG. 2.

The multiple sheet feed detector 32 includes a light emitting diode and a photodiode which are positioned on the opposite sides of the sheet feed path, and detects multiple sheet feeding on the basis of a variation of light intensity.

Figure 3:
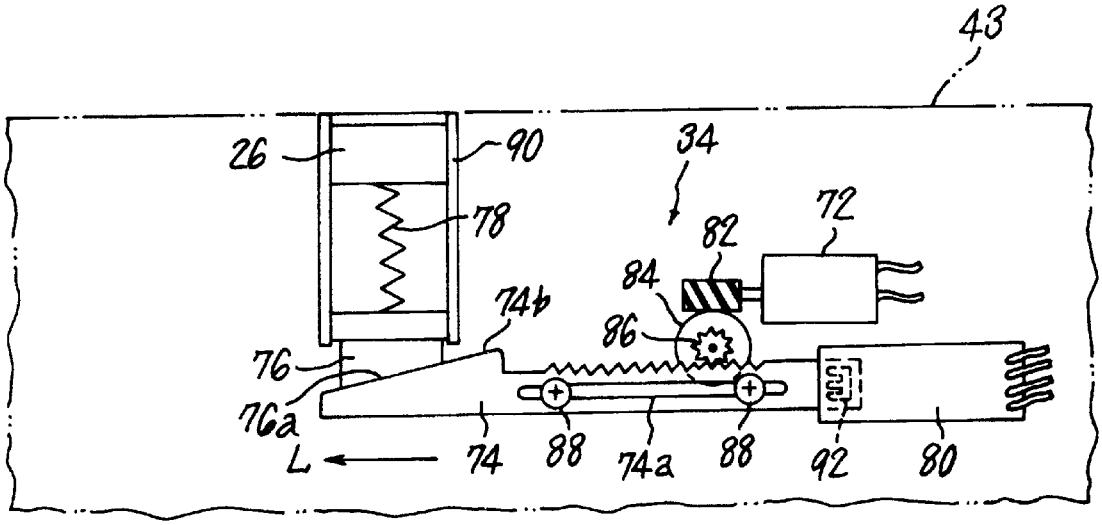
FIG. 3 is an enlarged side view of a separating pressure regulator, viewed from a side S shown in FIG. 1.

Referring to FIG. 3, the separating pressure regulator 34 mainly includes a separating pressure varying motor 72 (step motor), a rack 74, a pressing plate 76, a pressure applying spring 78, and a position detecting substrate 80. The rack 74 is movable transversely of the sheets 18 by the separating pressure varying motor 72. The pressing plate 76 is longitudinally displaced by the rack 74. The pressure applying spring 78 transmits the longitudinal displacement of the pressing plate 76 to the separating pad 26.

Similarly to the feeding pressure regulator 22, the separating pressure varying motor 72 receives a worm 82 at its rotary shaft, so that it transmits a rotational force of the rotary shaft to the rack 74 via a worm wheel 84 and a pinion 86 integral with the worm wheel 84. The rack 74 has a slit 74*a*, and has its lateral movement controlled by a pair of stepped screws 88 in the slit 74*a*.

The rack 74 has a tapered surface 74*b* at its one end near the pressing plate 76. The pressing plate 76 also has a tapered surface 76*a* in accordance with the pressing plate 76. Although not shown in FIG. 1, the separating pad 26 and the pressing plate 76 are longitudinally moved by a guide 90. When the rack 74 is moved in the direction L, the pressing plate 76 is lifted, so that the sheet separating pressure is raised in accordance with the increase of the urging force of the pressure applying spring 78. Similarly to the feeding pressure regulator 22, the position detecting substrate 80 of the rack 74 has a contact piece 92, so that an amount of displacement of the rack 74 is detected on the basis of a position of the contact piece 92 on a detecting pattern (not shown) of the position detecting substrate 80. FIG. 3 shows the separating pressure regulator 34 viewed from the direction S in FIG. 1.

Figure 4:
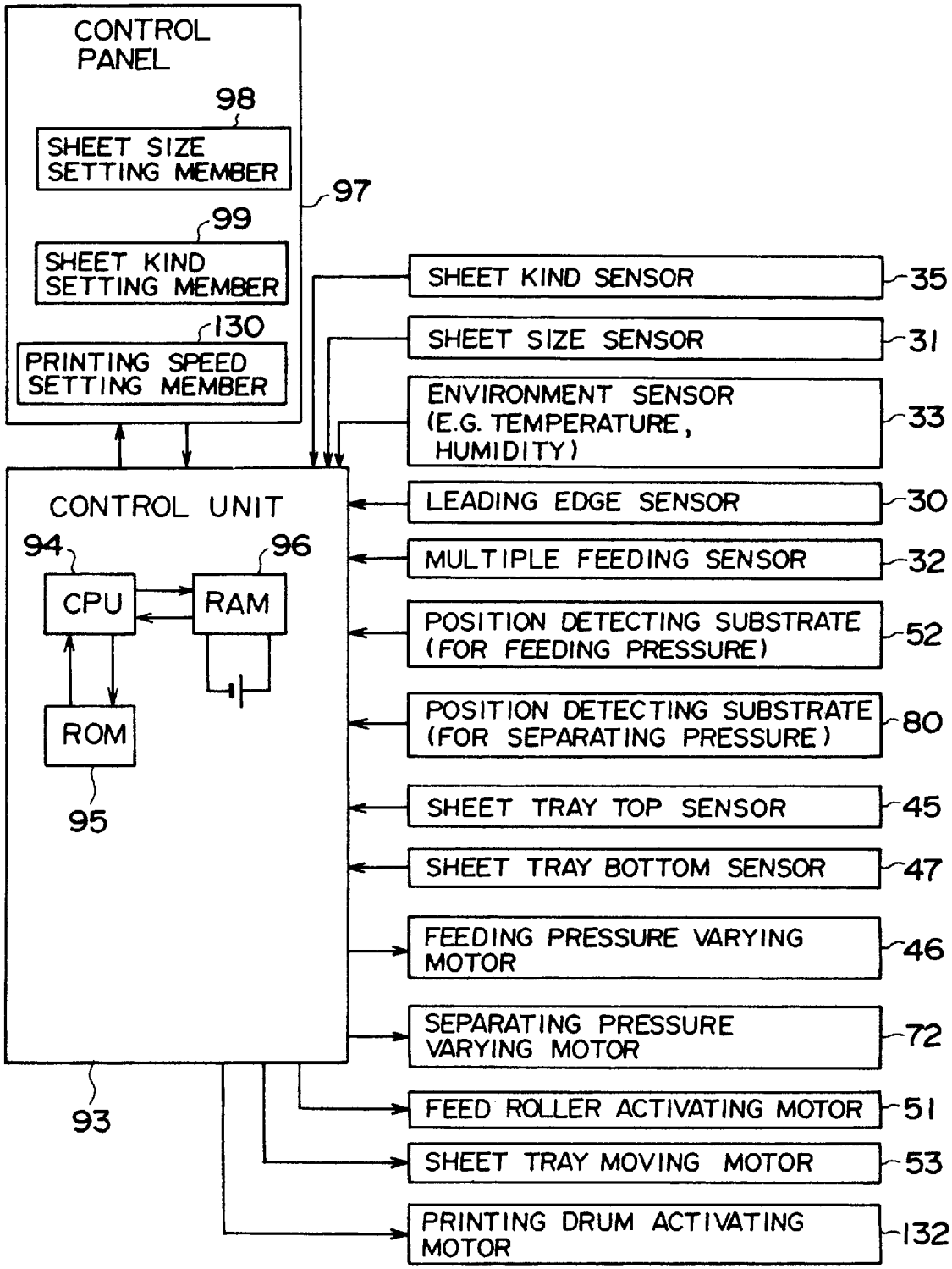
FIG. 4 is a block diagram of a control unit.

The sheet feeding apparatus 4 further includes sensors and devices as shown in FIG. 4, e.g. a sheet size sensor 31, an environment sensor 33, a sheet kind sensor 35, a sheet tray top sensor 45, a sheet tray bottom sensor 47, a motor 51 for activating the feed roller 20, a motor 53 for longitudinally moving the sheet tray 16, a sheet size setting member 98, a sheet kind setting member 99, and a printing speed setting member 130. The environment sensor 33 detects temperature and humidity in the printer 2.

The control unit 93 is constituted by a CPU 94 (i.e. a microcomputer), and a ROM 95 and a RAM 96 as storages. The ROM 95 stores reference sheet feeding times obtained through experiments. The RAM 96 stores reference sheet feeding times updated in accordance with various pieces of information.

The control unit 93 receives output signals from the leading edge sensor 30, multiple feeding sensor 32, position detecting substrates 52 and 80, sheet size sensor 31, sheet kind sensor 35 (for detecting a thickness or quality of the sheets), environment sensor 33, sheet tray top sensor 45, sheet tray bottom sensor 47, sheet size setting member 98, sheet kind setting member 99, and printing speed setting member 130. The control unit 93 then outputs signals to the feed pressure varying motor 46, separating pressure varying motor 72, feed roller activating motor 51, sheet tray moving motor 53, printing drum activating motor 132, and control panel 97. The control unit 93 then provides signals to these motors and control panel so as to control their operations.

Figure 5:
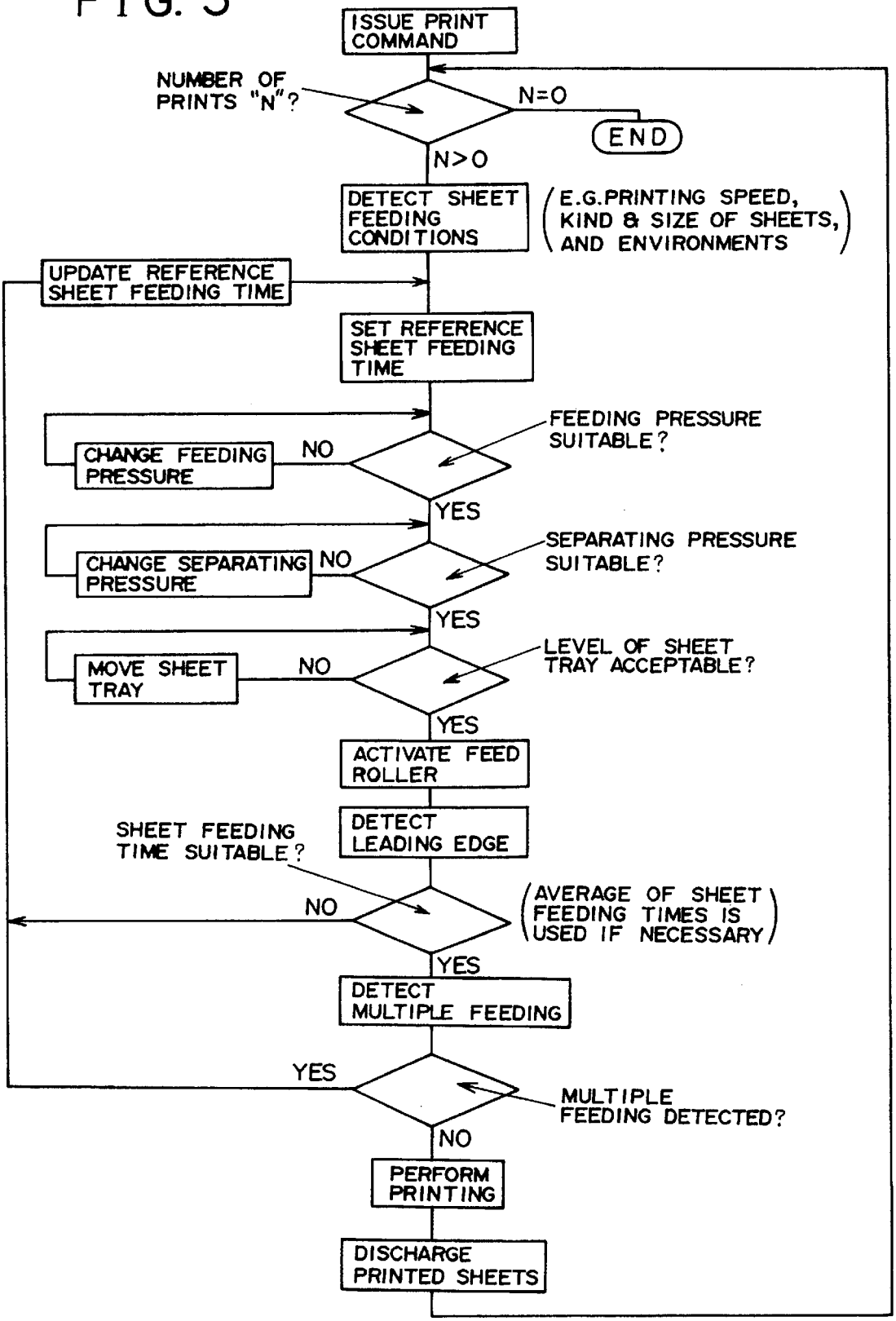
FIG. 5 is a flowchart showing a sheet feeding operation.

The sheet feeding apparatus 4 operates in a sequence shown in FIG. 5. A size or a kind of sheets 18 is selected by the sheet size setting member 98 or the sheet kind setting member 99. The printing speed setting member 130 selects a printing speed. The control unit 93 issues a print command via the control panel 97. The control unit 93 receives feeding data concerning the sheet size (e.g. B5 or A4), sheet kind (e.g. thin or thick), and the printing speed, temperature and humidity. The control unit 93 then extracts a predetermined reference sheet feeding time on the basis of the data from the ROM 95, and selects a sheet feeding pressure corresponding to the extracted sheet feeding time. With respect to suitability, this selected sheet feeding pressure is compared with a sheet feeding pressure which is determined on the basis of data obtained by the position detecting substrate 52.

If the sheet feeding pressure is not appropriate, the feeding pressure varying motor 46 is activated in accordance with the number of pulses necessary to optimally correct the sheet feeding pressure. The sheet feeding pressure which is present in the RAM 96 is updated in accordance with the optimally corrected sheet feeding pressure. The updated sheet feeding pressure will be used as an initial sheet feeding pressure for a succeeding printing operation. In other words, the control unit 93 will extract the updated value as the sheet feeding pressure from the RAM 96, when the printing operation is performed again for sheets whose kind is the same as that of the sheets for which the optimum sheet feeding pressure has been determined, after the printing operation is performed for sheets of a different kind.

Suitability of a sheet separating pressure is similarly checked by comparing a sheet separating pressure, which is selected on the basis of an extracted reference sheet feeding time, with a sheet separating pressure which is determined on the basis of data obtained by the position detecting substrate 80. If the sheet separating pressure is not suitable, the separating pressure varying motor 72 is operated in accordance with the number of correcting pulses, thereby determining an optimum sheet separating pressure. A sheet separating pressure which is present in the RAM 96 is updated in accordance with the optimally corrected sheet separating pressure, and is stored as an initial sheet separating pressure for a succeeding printing operation.

A level of the sheet tray 16 is then checked. If it is not suitable, the sheet tray moving motor 53 is activated so as to control the level of the sheet tray 16.

The feed roller activating motor 51 is then activated in order to rotate the feed roller 20. The control unit 93 calculates a time between a rotation command for the feed roller 20 and detection of a leading edge of a sheet 18 (i.e. a sheet feeding time) by the leading edge sensor 30. If the calculated sheet feeding time is longer than the reference sheet feeding time extracted from the ROM 95, the control unit 93 recognizes that the sheet feeding pressure is insufficient. In this case, an operation signal is provided to the feeding pressure varying motor 46, thereby increasing the sheet feeding pressure by one level. Conversely, if the detected sheet feeding time is shorter than the reference sheet feeding time, the feeding pressure varying motor 46 is activated so as to reduce the sheet feeding pressure by one level.

In this embodiment, the leading edge sensor 30 constitutes the sheet feeding time detector 29 together with the control unit 93. This enables the sheet feeding time to be detected by a simple structure.

Alternatively, the sheet feeding pressure may be reliably and optimally controlled when the reference sheet feeding time is set with a certain tolerance by considering various factors related to the sheet feeding operation. Further, it is also possible to reliably control the sheet feeding pressure whenever a detected sheet feeding time deviates from the reference sheet feeding time by a predetermined extent or more.

In this embodiment, the control unit 93 calculates the time from the rotation command to the feed roller 20 till the detection of the leading edge of sheets by the leading edge sensor 30. In other words, the control unit 93 has the sheet feeding time detecting function of the sheet feeding time detector 29. Alternatively, the sheet feeding time detector may be configured as follows. Two leading edge sensors 30 may be separately disposed in the sheet feed path between the separating pad 26 and the register rollers 28 (shown in FIG. 1). Thus, the control unit 93 measures a time for the sheet 18 to pass through these leading edge sensors 30. In this case, since the sheet feeding time is measured while the sheet 18 is in a steady state, so that the sheet feeding time can be more reliably measured and controlled. Still further, the sheet feeding time detector 29 may be separate from the control unit 93, measure a sheet feeding time, and provide it to the control unit 93.

When the sheet size sensor 31 detects a size of sheets 18 or when the sheet size setting member 98 sets a sheet size, a sheet feeding time of a sheet of the detected or set sheet size is compared with a reference sheet feeding time which is predetermined for the corresponding sheet size, and is extracted from the ROM 95.

Similarly, when the sheet kind sensor 35 detects a kind of sheets 18 or when the sheet kind setting member 99 sets a sheet kind, a sheet feeding time of a sheet of the detected or set sheet kind is compared with a reference sheet feeding time which is predetermined for the corresponding sheet kind and is extracted from the ROM 95.

Sometimes, an initial printing speed which is selected when the printer is turned on may be changed by the printing speed setting member 130 in accordance with a kind of sheets, a density of an original image, and so on. In such a case, a sheet feeding time for the changed printing speed is compared with a reference sheet feeding time predetermined for the corresponding printing speed, and extracted from the ROM 95. Thus, the sheet feeding time will be controlled to be optimum in accordance with the printing speed.

If the sheet feeding time increased by one adjustment level is still longer than the predetermined reference sheet feeding time, it will be further increased by another level. Conversely, if the sheet feeding time reduced by one level is still shorter than the predetermined reference sheet feeding time, it will be further reduced by another level. Further, if the sheet feeding time extensively deviates from the reference sheet feeding time, it may be first set to a value which is larger or smaller by three levels than the reference value, and may be then increased or reduced by one level. The sheet feeding time can be reliably and optimally controlled when each level is finely set.

The invention features that the sheet feeding pressure can be controlled without interrupting the printing operation, even when the detected sheet feeding time is longer or shorter than the reference sheet feeding time. This can improve operating efficiency of the printer. Generally, it is acceptable to simply compare the detected sheet feeding time of one sheet 18 with the reference sheet feeding time. However, when an average of sheet feeding times detected for a plurality of sheets 18 is compared with the reference sheet feeding time, the reference sheet feeding time may be reliably updated without being adversely affected by randomly obtained non-standard sheet feeding times.

The reference sheet feeding time is appropriately extracted from the ROM 95 in response to output signals indicative of the environmental factors and provided to the control unit 93 from the environment sensor 33.

If the multiple sheet feed detector 32 detects that a plurality of sheets are fed at a time, an operation signal is provided to the sheet separating pressure varying motor 72, which is activated so as to adjust the reference sheet separating pressure. This prevents multiple sheet feeding.

The sheet separating pressure may be controlled in several levels as with the sheet feeding pressure.

The sheets 18 are conveyed to the printing section 10 by the register rollers 28 which rotate in synchronization with the rotation of the printing drum 6. Printed sheets 18 are discharged onto the printed sheet tray 14 via the absorbing unit 12.

When the sheet feeding pressure reaches a predetermined value, the control unit 93 issues a signal indicative of this state to the control panel 97. The control panel 97 indicates an advance notice to replace the feed roller 20. In response to this notice, a fresh feed roller will be made available.

Further, when the sheet feeding pressure becomes maximum and when the sheet feeding time is above the reference sheet feeding time, the control unit 93 informs this to the control panel 97. The control panel 97 will urge the exchange of the sheet feed roller 20. The sheet feed roller 20 in question will be replaced with the available fresh one.

In order for an operator to inspect non-sheet feeding of a worn-out sheet feed roller 20, he or she has to be skilled in such an inspection job. Thus, the inspection job would become unreliable, and be disadvantageous in the following respects: a time necessary for determining a replacement time; sheets jammed and wasted by no-sheet feeding; and waste of time due to non-operating period of the printer when a fresh feed roller is made in hand and when the worn-out feed roller is being replaced. However, these problems can be overcome by replacing the worn-out feed roller in response to the advance notice concerning the replacement which is issued on the basis of the data obtained by the related sensors.

Each reference sheet feeding pressure can be set as desired via the control panel 97 by the operator or maintenance personnel. Further, each reference sheet pressure (which is updated through detection during the sheet feeding operation) can be returned to an initial value whenever the sheet feed roller is replaced, or whenever the operator wishes.

Thus, it is possible for the sheet feeding apparatus to precisely handle sheets which do not satisfy requirements for standard sheets.

Whenever the worn-out feed roller is replaced with a fresh one, the sheet feeding pressure is reset to the initial value. The sheet feeding apparatus can start its operation in an optimum state. Even when an abnormal sheet feeding time is determined for a non-standard sheet, it can be cleared immediately after such a sheet is discharged.

Figure 6:
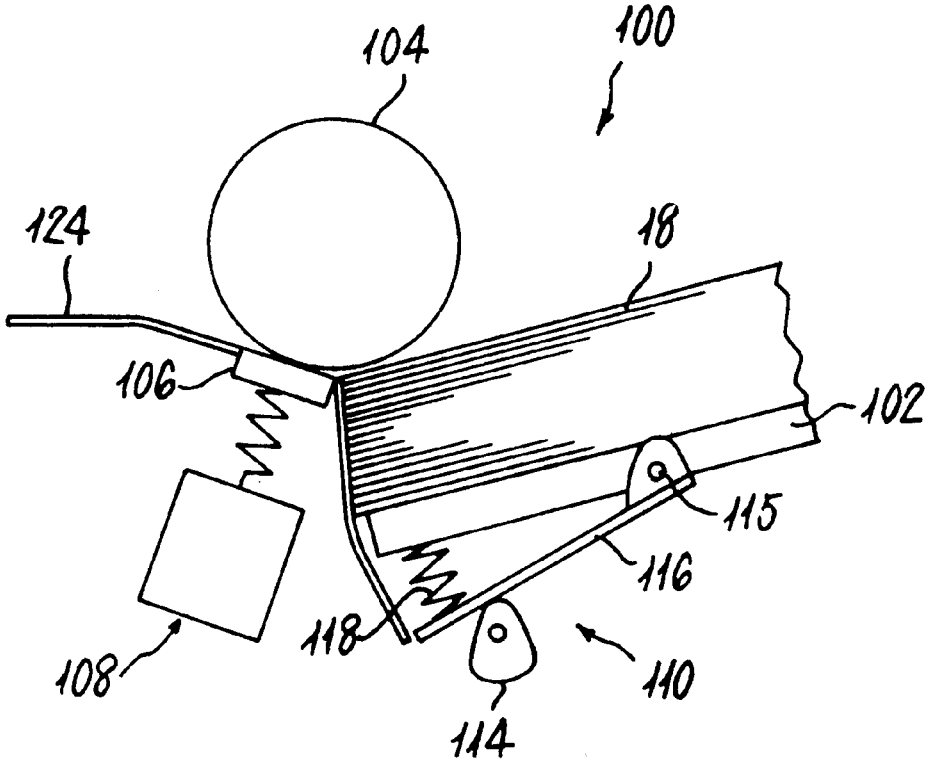
FIG. 6 is a side view of the main part of a feeding pressure regulator in a modified example of the invention.
Figure 7:
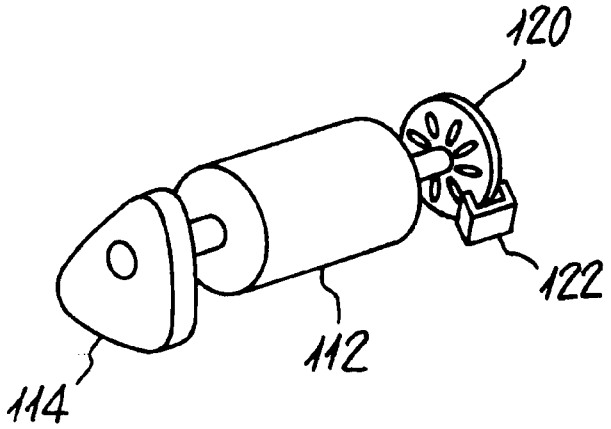
FIG. 7 is a side perspective view of the main part of the feeding pressure regulator of FIG. 6.
Figure 8:
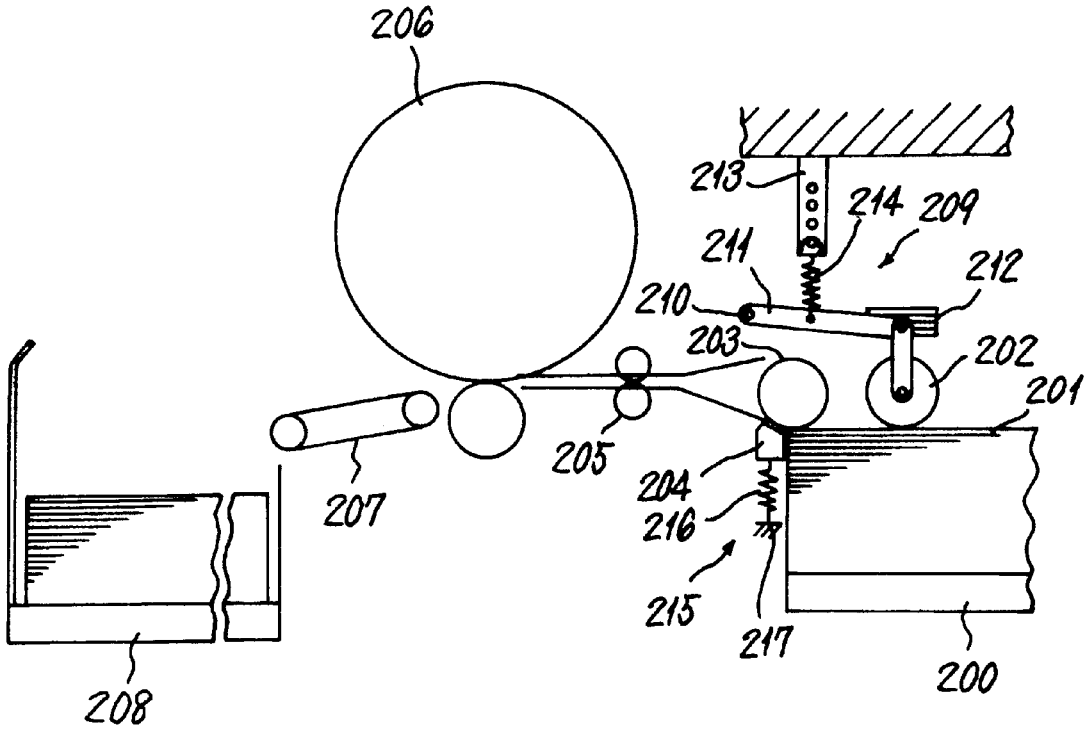
FIG. 8 PRIOR ART
FIG. 8 is a schematic side view of a printing machine into which a sheet feeding apparatus of the prior art is incorporated.

FIGS. 6 and 7 show how a sheet feeding pressure is varied in a modified example of the foregoing embodiment. In this case, the sheet feeding pressure is adjusted by varying a sheet tray pushing pressure.

In this example, a sheet feeding apparatus 100 mainly comprises a sheet tray 102, a sheet feeding/separating roller 104, a separating pad 106, a separating pressure regulator 108, a feed pressure regulator 110, and a control unit (not shown). The sheet tray 102 is movably supported by a fulcrum 115.

The feed pressure regulator 110 mainly includes a feeding pressure varying motor 112, a cam 114 fixed to a rotary shaft of the feed pressure varying motor 112, a pressure varying plate 116, and a pressure applying spring 118 disposed between the pressure varying plate 116 and the sheet tray 102. The pressure varying plate 116 is supported by the fulcrum 115 at its one end, and is longitudinally movable at the other end thereof. The feeding pressure varying motor 112 has an encoder disc 120, which is synchronously rotatable with the motor 112. A sensor 122 connected to the control unit detects a rotational displacement of the encoder disk 120. Referring to FIG. 6, reference numeral 124 denotes a sheet guide.

When the feeding pressure varying motor 112 is activated and an angle of the cam 114 is changed, the pressure varying plate 116 is displaced. An urging force of the spring 118 varies with the displacement of the pressure varying plate 116, thereby varying the sheet feeding pressure. If a detected sheet feeding time deviates from the reference sheet feeding time, a signal is provided to the feeding pressure varying motor 112, which is activated in accordance with a level to control the sheet feeding pressure, so that the sheet feeding pressure will be increased or reduced as described in the foregoing embodiment.

FIG. 6 shows the sheet separating pressure regulator 108 in a simplified manner. However, the regulator 108 is similarly structured as in the foregoing embodiment.

What is claimed is:

1. A sheet feeding apparatus, comprising:

(a) a sheet feed roller for feeding sheets toward a printing section;

(b) a sheet feeding pressure regulating mechanism for regulating a sheet feeding pressure;

(c) a pair of register rollers for periodically conveying the sheets to the printing section;

(d) a sheet feeding time detector for detecting a sheet feeding time, wherein the sheet feeding time detector is positioned upstream of the register rollers in a sheet feed path; and (f) a control unit for controlling operations of the sheet feed roller, the sheet feeding pressure regulating mechanism and the pair of register rollers, the control unit comparing a sheet feeding time detected by the sheet feeding time detector with a predetermined reference sheet feeding time, and controlling the sheet feeding pressure regulating mechanism on the basis of a comparison of the detected sheet feeding time with the predetermined reference sheet feeding time during a sheet feeding operation.

2. The sheet feeding apparatus according to claim 1, wherein the control unit calculates the sheet feeding time.

3. The sheet feeding apparatus according to claim 1 or 2, wherein the sheet feeding time detector detects sheet feeding times of a plurality of sheets, and an average of detected sheet feeding times is compared with the predetermined reference sheet feeding time.

4. The sheet feeding apparatus according to claim 1 or 2, further comprising a sheet size sensor for detecting a sheet size, wherein when the sheet size sensor detects the sheet size, and the detected sheet feeding time of a sheet of the detected sheet size is compared with the reference sheet feeding time predetermined for the detected sheet size.

5. The sheet feeding apparatus according to claim 1 or 2, further comprising a sheet size setting member for setting a sheet size, wherein when the sheet size setting member sets the sheet size, and the detected sheet feeding time of a sheet of the set sheet size is compared with the reference sheet feeding time predetermined for the set sheet size.

6. The sheet feeding apparatus according to claim 1 or 2, further comprising a sheet kind sensor for detecting a sheet kind, wherein when the sheet kind sensor detects the sheet kind, and the detected sheet feeding time of a sheet of the detected sheet kind is compared with the reference sheet feeding time predetermined for the detected sheet kind.

7. The sheet feeding apparatus according to claim 1 or 2, further comprising a sheet kind setting member for setting a sheet kind, wherein when the sheet kind setting member sets the sheet kind, and the detected sheet feeding time of a sheet of the set sheet kind is compared with the reference sheet feeding time predetermined for the set sheet kind.

8. The sheet feeding apparatus according to claim 1 or 2, further comprising a printing speed setting member for setting a printing speed, wherein when the printing speed is set by the printing speed setting member, the detected sheet feeding time for the set printing speed is compared with the reference sheet feeding time predetermined for the set printing speed.

9. The sheet feeding apparatus according to claim 1 or 2, further comprising an environment sensor for detecting at least one of temperature and humidity, wherein the sheet feeding time detected under the detected at least one of temperature and humidity is compared with the reference sheet feeding time predetermined for the detected at least one of temperature and humidity.

10. The sheet feeding apparatus according to claim 1 or 2, wherein the control unit issues an advance notice concerning a time for exchanging the sheet feed roller when the sheet feeding pressure of the sheet feeder roller reaches a predetermined sheet feeding pressure, and urges to exchange the sheet feed roller when the sheet feeding pressure is above a predetermined maximum value and when the sheet feeding time exceeds the predetermined reference sheet feeding time.

11. The sheet feeding apparatus according to claim 1 or 2, wherein the sheet feeding pressure is optionally determined.

12. The sheet feeding apparatus according to claim 1 or 2, wherein the sheet feeding pressure is updated and optionally reset to an initial value.

13. The sheet feeding apparatus according to claim 1 or 2, further comprising a multiple feed sensor for detecting multiple sheet feeding, disposed upstream of the register rollers in the sheet feed path, and a sheet separating pressure regulating mechanism for regulating a sheet separating pressure, wherein when multiple sheet feeding is detected by the multiple feed sensor, the control unit operates the sheet separating pressure regulating mechanism.

14. A sheet feeding apparatus, comprising:

(a) a sheet feed roller for feeding sheets to a printing section;

(b) a sheet separating pressure regulating mechanism for regulating a sheet separating pressure;

(c) a pair of register rollers for periodically conveying the sheets to the printing section;

(d) a multiple sheet feeding sensor for detecting multiple sheet feeding, wherein the multiple sheet feeding sensor is disposed upstream of the register rollers in a sheet feed path; and (e) a control unit for controlling operations of the sheet feed roller, the sheet separating pressure regulating mechanism and the pair of register rollers, and operating the sheet separating pressure regulating mechanism when multiple sheet feeding is detected by the multiple sheet feeding sensor.

* * * * *

UNITED STATES PATENT AND TRADEMARK OFFICE

CERTIFICATE OF CORRECTION

PATENT NO. : 5,927,703

DATED : July 27, 1999

INVENTOR(S) : ENDO

It is certified that error appears in the above-identified patent and that said Letters Patent is hereby corrected as shown below:

Column 1, line 52, "A pressure by which the sheets 201 comes into contacts" should be --The pressure by which the sheets 201 come into contact--.

Column 2, line 42, "with accordance" should be --in accordance--.

Column 3, line 59, "with" should be --without--.

line 62, change "size," to --size;--.

Column 9, line 3, delete "since".

Signed and Sealed this

Twentieth Day of February, 2001

*Attest:*

Nicholas P. Godici

NICHOLAS P. GODICI

*Attesting Officer*

*Acting Director of the United States Patent and Trademark Office*